United States Patent [19]

Stewart et al.

[11] Patent Number: 4,998,362

[45] Date of Patent: Mar. 12, 1991

[54] PICTURE FRAME ASSEMBLY

[75] Inventors: Brian S. Stewart, San Francisco; James E. Sacherman; John W. Toor, both of Palo Alto, all of Calif.

[73] Assignee: Acme Frame Products, Inc., Chicago, Ill.

[21] Appl. No.: 289,590

[22] Filed: Dec. 22, 1988

[51] Int. Cl.[5] ..... A47G 1/06; G09F 1/12

[52] U.S. Cl. ..... 40/152.1; 40/152; 40/606

[58] Field of Search ..... 40/152, 154, 156, 642, 40/661, 611, 606, 607, 610, 152.1, 124; 248/476, 460, 910, 912, 916, 224.4, 223.4

[56] References Cited

U.S. PATENT DOCUMENTS

| | | | |
|---|---|---|---|
| 737,124 | 8/1903 | Manor | 40/154 |
| 1,220,418 | 3/1917 | Hawkes | 40/156 |
| 2,167,564 | 7/1939 | Fonda | 40/606 |
| 2,208,344 | 7/1940 | Reynolds | 40/152.1 |
| 2,528,366 | 10/1950 | Houston | 40/152 |
| 2,747,311 | 5/1956 | Fulmer | 40/642 |
| 2,950,787 | 8/1960 | Walsh | 40/606 |
| 2,958,490 | 11/1960 | Johnson | 248/460 |
| 3,102,352 | 9/1963 | White | 40/606 |
| 3,161,975 | 12/1964 | McMillan | 40/152 |
| 3,200,527 | 8/1966 | Clark | 40/152 |
| 3,370,822 | 2/1968 | Miller | 248/476 |
| 3,813,799 | 6/1974 | Caravello | 40/152 |
| 3,822,782 | 7/1974 | Ringle et al. | 40/661 |
| 3,873,342 | 3/1975 | Ellison | 40/152 |
| 3,898,870 | 8/1975 | Jacobson | 40/156 |
| 4,232,467 | 11/1980 | Stewart | 40/607 |
| 4,277,904 | 7/1981 | Leuthesser | 40/564 |
| 4,333,253 | 6/1982 | Cooper | 40/642 |
| 4,432,152 | 2/1984 | Daenen | 40/154 |
| 4,438,579 | 3/1984 | Engel | 40/661 |
| 4,610,417 | 9/1986 | Kuss | 248/460 |
| 4,694,596 | 7/1987 | Fast | 40/663 |
| 4,779,366 | 10/1988 | Jost | 40/154 |
| 4,802,294 | 2/1989 | Baus | 40/156 |

*Primary Examiner*—Kenneth J. Dorner
*Assistant Examiner*—J. Hakomaki
*Attorney, Agent, or Firm*—Calfee, Halter & Griswold

[57] ABSTRACT

A picture frame assembly comprising a frame for displaying a photograph or similar two dimensional work of art, an upright support attached to the frame, and a base upon which the upright support is mounted. The frame includes a detachable transparent cover for securing the photograph to the frame. The front surface of the frame includes a recess for receiving a photograph and the cover. Surrounding the recess and forming a part of the front surface is a border portion. The recess comprises a bottom surface and a sidewall. The inner edge of the sidewall connects the sidewall to the bottom surface of the recess, and the outer edge of the sidewall connects the sidewall to the border portion. The cover is inserted through the front of the frame and received within the recess such that the front surface of the cover is disposed between the outer edge of the sidewall and the bottom surface of the recess. Included along the rear surface of the cover are a plurality of protruding legs which engage the bottom surface of the recess and ensure the secure retention of the cover within the recess. The upright support includes a front side having a first geometrical profile and a second side having a second geometrical profile. Each side of the upright support includes mounting means to facilitate the selective mounting of the frame upon either side of the support so as to allow the frame to be displayed in different orientations relative to the base.

12 Claims, 10 Drawing Sheets

PICTURE FRAME ASSEMBLY

DISCLOSURE OF THE INVENTION

This invention relates to a device for displaying a photograph or similar two dimensional work of art. More particularly, the present invention relates to a picture frame assembly having a unique frame construction which includes a removable cover, and an upright support and base which allow a user to display a photograph in various orientations relative to the base.

Filed concurrently herewith by the applicants is a design application entitled PICTURE FRAME ASSEMBLY OR SIMILAR ARTICLE which concerns the subject matter of the present invention.

BACKGROUND

The prior art provides a multitude of picture frame assemblies for displaying photographs or similar two dimensional works of art. Some of these picture frame assemblies are designed to be mounted on a vertical wall or surface such as the assembly shown in McMillan U.S. Pat. No. 3,161,975. Other prior art frame assemblies, such as that shown in Daenen U.S. Pat. No. 4,432,152 are intended to be mounted upon a horizontal surface such as a table or desk top. With respect to picture frame assemblies which are designed for use on horizontal surfaces, such picture frame assemblies utilize various means to support the frame upon the horizontal surface including the easel shown in Johnson U.S. Pat. No. 2,958,490 and the hanger/holder disclosed by Daenen.

In many prior art picture frame assemblies a transparent cover is mounted through the back of the frame as shown by McMillan. This type of a picture frame assembly can require considerable disassembly in order to remove the photograph or provide access to the backside of the cover.

In other prior art picture frame assemblies, like that disclosed by Daenen, the cover is mounted in a recess formed in the front of the frame. Surrounding the recess is a border. With the Daenen frame, upon installation of the cover within the recess, the cover is positioned flush with the border of the frame and it is secured within the recess as a result of the frictional engagement between the edges of the cover and the sidewall of the recess.

In another prior art picture frame assembly, which was developed by one of the applicants, the frame includes a cover with protruding legs which engage sockets formed in the frame. However, the frame of this assembly does not include a recess for receiving the cover.

SUMMARY OF THE INVENTION

The present invention provides a picture frame assembly which allows a user to display a photograph or similar two dimensional work of art in a unique manner. Specifically, applicants' invention provides a new frame construction and a novel frame assembly which affords a variety of viewing orientations.

Applicants' frame construction includes a detachable transparent cover. The transparent cover is received completely within a recess formed in the frame such that the front of the cover is spaced from the border portion surrounding the recess, between the bottom surface of the recess and the border portion. The cover is secured to the frame by engaging the bottom surface of the recess. No frictional engagement occurs between the cover and the sidewall of the recess.

The picture frame assembly also provides a detachable upright support which allows a user to display the frame at two different orientations relative to the base. In order to provide additional viewing flexibility, the upright support may be attached along any of the various lengths (i.e., top, bottom and lateral edges) of the frame.

In a preferred embodiment the picture frame assembly comprises a frame, an upright support and a base. The construction of the frame is such that it affords a unique aesthetic appearance for viewing a photograph. More particularly, the frame includes a detachable rectangular transparent cover having an edge with a bevelled portion which extends along the entire outer perimeter of the cover. The front side of the frame includes a recess which is adapted to receive a photograph or similar two dimensional work of art and one or more pieces of mat (if desired). The transparent cover is designed to be inserted in the recess so as to sandwich the photograph and mat against the bottom surface of the recess. Surrounding the recess is a border portion. The border portion may be used as a mounting surface for a piece of mat. Extending between the bottom surface of the recess and the border portion is a sidewall. The inner edge of the sidewall connects the sidewall to the bottom surface while the outer edge of the sidewall connects the sidewall to the border portion. The sidewall includes a bevelled portion and a straight portion. The bevelled portion comprises a substantial part of the sidewall. Located at the intersection of the bevelled portion and the straight portion is the inner edge of the bevelled portion. Upon installation of the transparent cover, mat and photograph within the recess, the front surface of the cover is located between the outer edge of the sidewall and the bottom wall of the recess. Also, upon installation of the cover within the recess, the inner edge of the bevelled portion of the cover is substantially contiguous with the inner edge of the bevelled portion of the sidewall.

Included on the rear surface of the cover, at each of its corners, are protruding L-shape legs. Each of the legs along one of its outer surfaces includes a detent. Upon installation of the transparent cover within the recess, the protruding legs are received within and engage L-shape sockets formed in the bottom surface of the recess to thereby retain the cover, photograph and mat within the recess.

Applicants' invention further provides means for supporting the frame at two different angles relative to the base and along each side of the frame. More particularly, the upright support upon which the frame is supported includes a front side having a first geometric profile which extends at an angle perpendicular to the horizontal axis of the base, and a back side having a second geometric profile which extends at an angle of less than 90° relative to the horizontal axis of the base. Each side of the upright support includes attachment means which allow the frame to be selectively mounted to the support upon either the front or back side of the support. Attachment of the support to the frame is facilitated by top and bottom protruding ledges which are provided on each side of the support and a protruding V-shape tab which extends along the top of the upright support. The protruding tab extends perpendicular to the vertical axis of the support from about the distal end of the top ledge located on the front side of the support to the distal end of the top ledge located on the back side of the support. The rear side of the frame includes corresponding channels for receiving the protruding ledges and corresponding V-shape openings for receiving the protruding tab. The channels extend along the entire perimeter of the frame and a V-shape opening for receiving the protruding tab of the support is included along each of the top, bottom, right and left edges of the frame.

The upright support is attached to the frame by aligning and inserting the tab and ledges located on either side of the support within the respective channels and openings formed in the rear side of the frame. In addition to being able to attach the support to the frame along either the front or the back side of the support, the support may be selectively attached to the frame along each its top, bottom, right or left edges or lengths.

Releasably attached to the bottom of the upright support is the base. The upright support includes a male plug having a pair of diametrically opposed tabs. Included at the end of the plug are a plurality of indentations. Included in the base is a socket having a plurality of cross-pieces. The cross-pieces correspond in placement and size to the indentations formed in the plug. Upon insertion of the plug into the socket, the tabs deflect inwardly. When the indentations on the plug contact the respective cross-pieces of the socket, additional travel of the socket into the plug is prevented. Simultaneously therewith, the tabs return to their unbiased position and protrusions provided at the ends of the tabs engage the bottom edges of the end walls of the socket thereby locking the support upon the base. Upon exertion of a separating force upon the base and the support, and upon deflection of the tabs inwardly with a user's fingers the support may be released from the base.

The foregoing and other features of the invention are hereinafter more fully described and particularly pointed out in the claims, the following description and the annexed drawings setting forth in detail a certain illustrated embodiment of the invention, this being indicative, however, of one of the various ways in which the principles of the invention may be employed.

BRIEF DESCRIPTION OF THE DRAWINGS

In the annexed drawings

DETAILED DESCRIPTION OF THE PREFERRED EMBODIMENT

Figure 1:
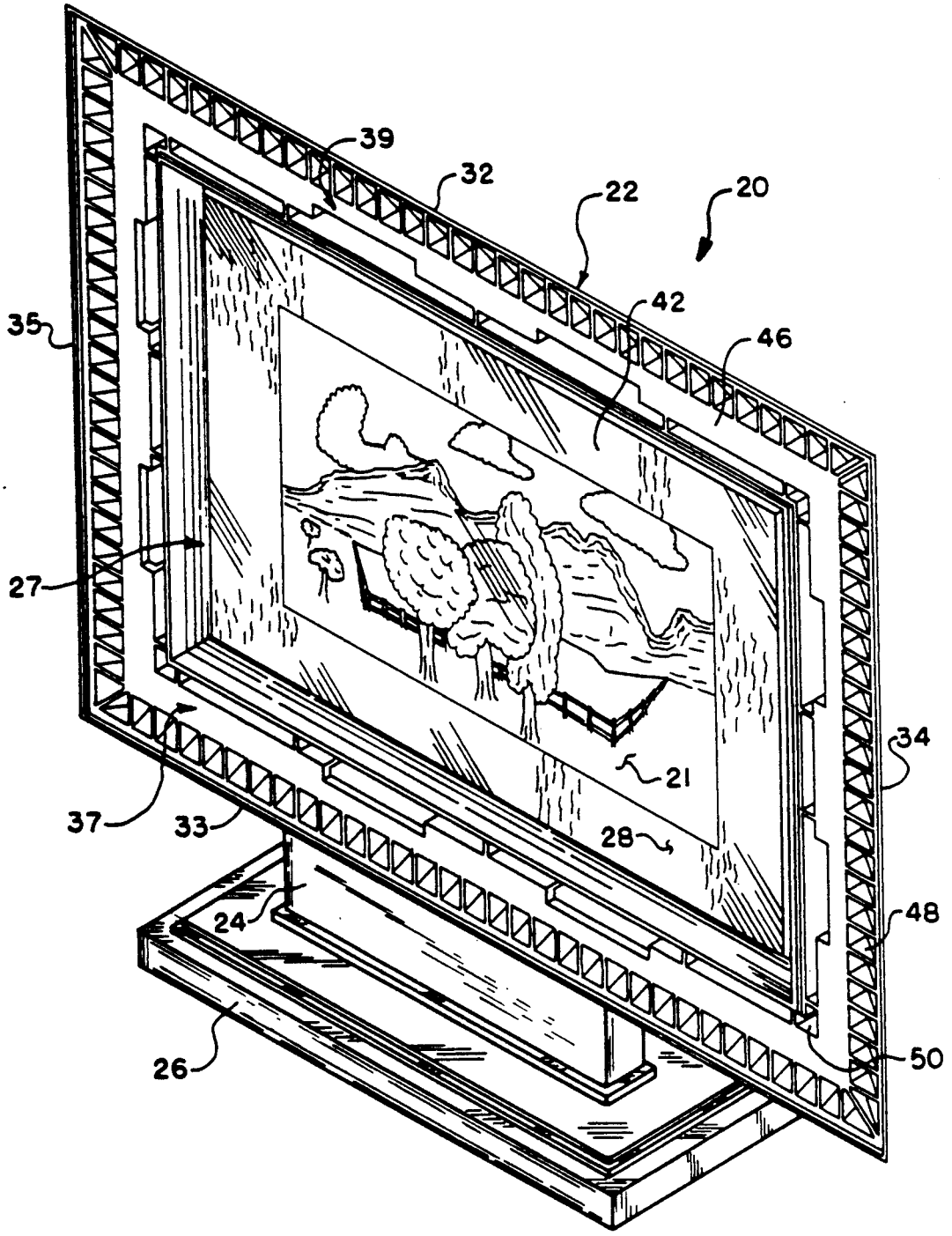
FIG. 1 is a perspective view of a picture frame assembly made in accordance with the present invention with the mat covering the border portion of the frame removed.

Referring to the drawings and initially to FIGS. 1–4, 9 and 9A, there is illustrated a picture frame assembly 20 made in accordance with the present invention which facilitates the display and viewing of a photograph 21 or similar two dimensional work of art such as a drawing, painting or sketch. Generally, picture frame assembly 20 comprises a rectangular frame 22, an upright support 24 and a base 26. Detachably mounted within a recess 27 formed in the front of the frame 22 is a rectangular transparent cover 28. Transparent cover 28 serves to secure or retain the photograph 21 upon the frame 22 and permit the viewing of the photograph 21.

Picture frame assembly 20 provides several distinct advantages which are further discussed below. Specifically, picture frame assembly 20 allows the frame 22 to be supported upon the upright support 24 along either the straight front side 29 or the angled back side 30 of the support 24, and along either the top 32, bottom 33, right 34 or left 35 edges or lengths of the frame 22. Picture frame assembly 20 also permits the installation of a photograph 21, one or more pieces of mat 36 (if desired) and the transparent cover 28 through the front 37 of the frame 22 with the front surface 42 of the cover 28 spaced from the border portion 39 which surrounds the recess 27. More particularly, the front surface 42 of the cover 28 is located between the outer edge 40, formed at the intersection of the border portion 39 and the recess 27, and the bottom surface 41 of the recess 27.

All of the components of the picture frame assembly 20, exclusive of the cover 28, are preferably molded from a high impact polystyrene plastic. Also, the frame 22 is preferably integrally molded as a single piece. The cover 28 is preferably molded from an acrylic plastic which affords a clear transparent view of the underlying mat 36 and photograph 21. However, it will be appreciated that a picture frame assembly 20 made in accordance with the present invention may be produced utilizing any one of a variety of materials and production processes.

Figure 4:
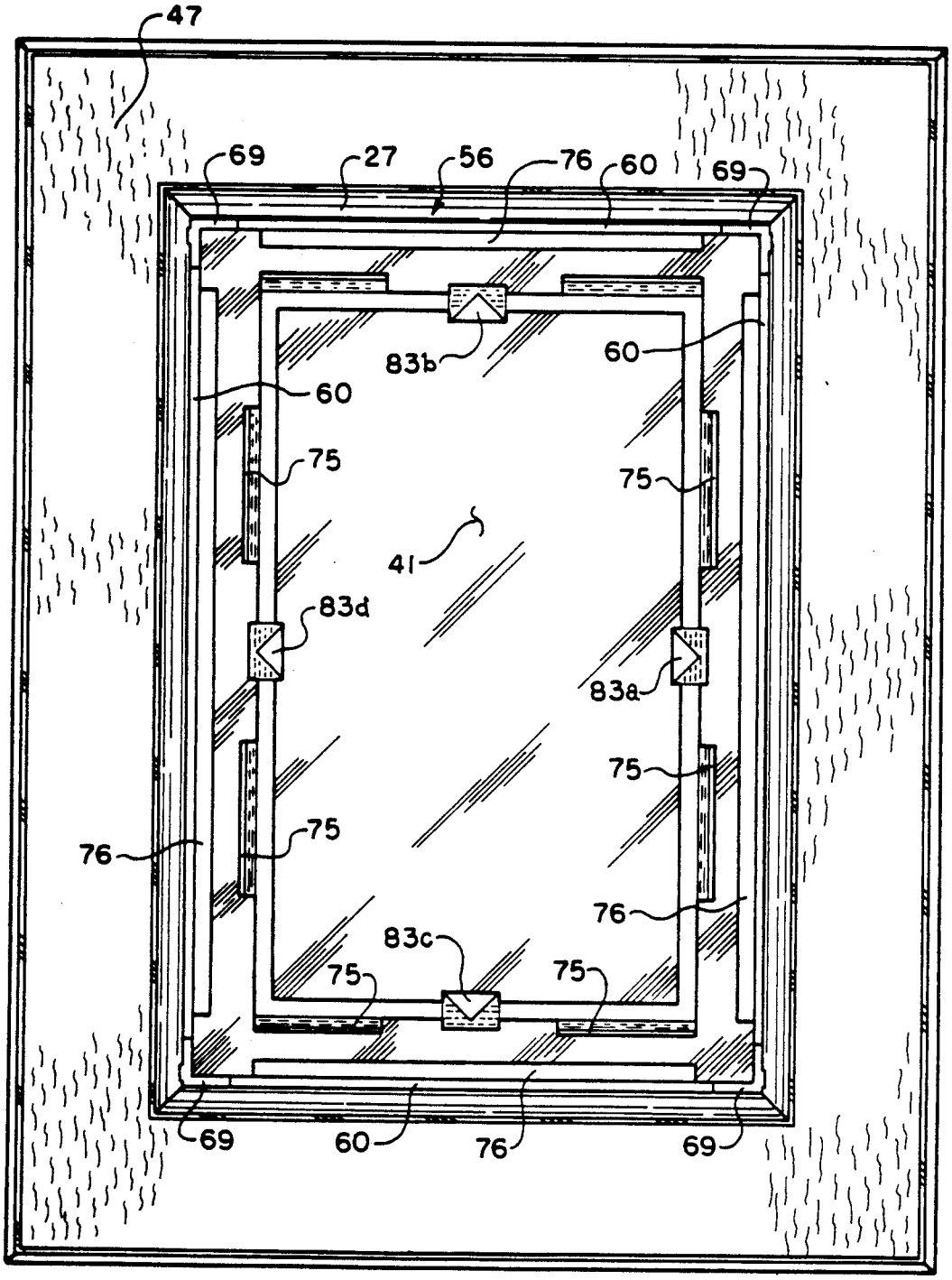
FIG. 4 is a front plan view of the frame shown in FIG. 1 with the mat covering the border portion illustrated, and the cover, mat and photograph contained within the recess removed.
Figure 5:
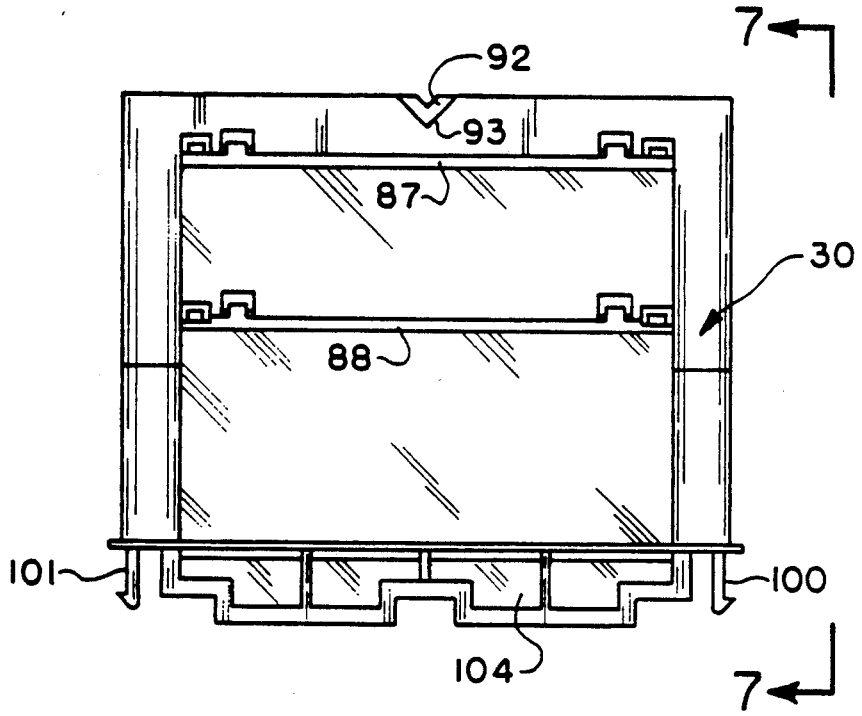
FIG. 5 is a front plan view of the upright support shown in FIG. 1.
Figure 6:
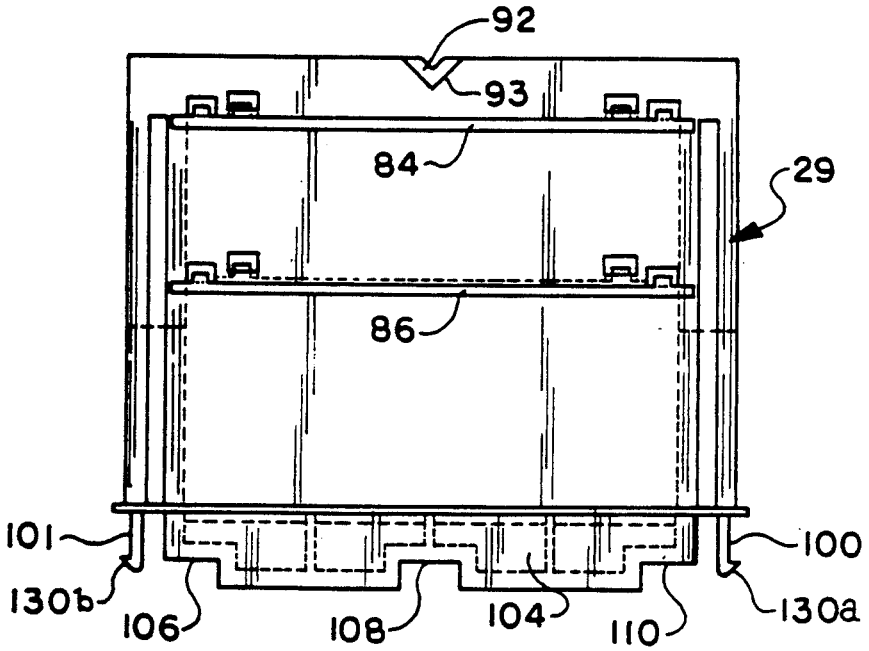
FIG. 6 is a rear plan view of the upright support shown in FIG. 1.

The front side 38 of the frame 22 includes the recess 27 and the border portion 39 which extends beyond and surrounds the recess 27. The border portion 39 includes a mounting surface 46 upon which a piece of mat 47 may be mounted utilizing a suitable adhesive or sticky dots. Located in the immediate proximity of the mounting surface 46 are a multitude of indentations 48, depressions 50 and openings 52 which facilitate the molding of the frame 22 and the conservation of material. Upon installation of a piece of mat 47 upon the border portion 39, the indentations 48, depressions 50 and openings 52 are hidden from view as shown in FIG. 4.

Figures 2, 2A:
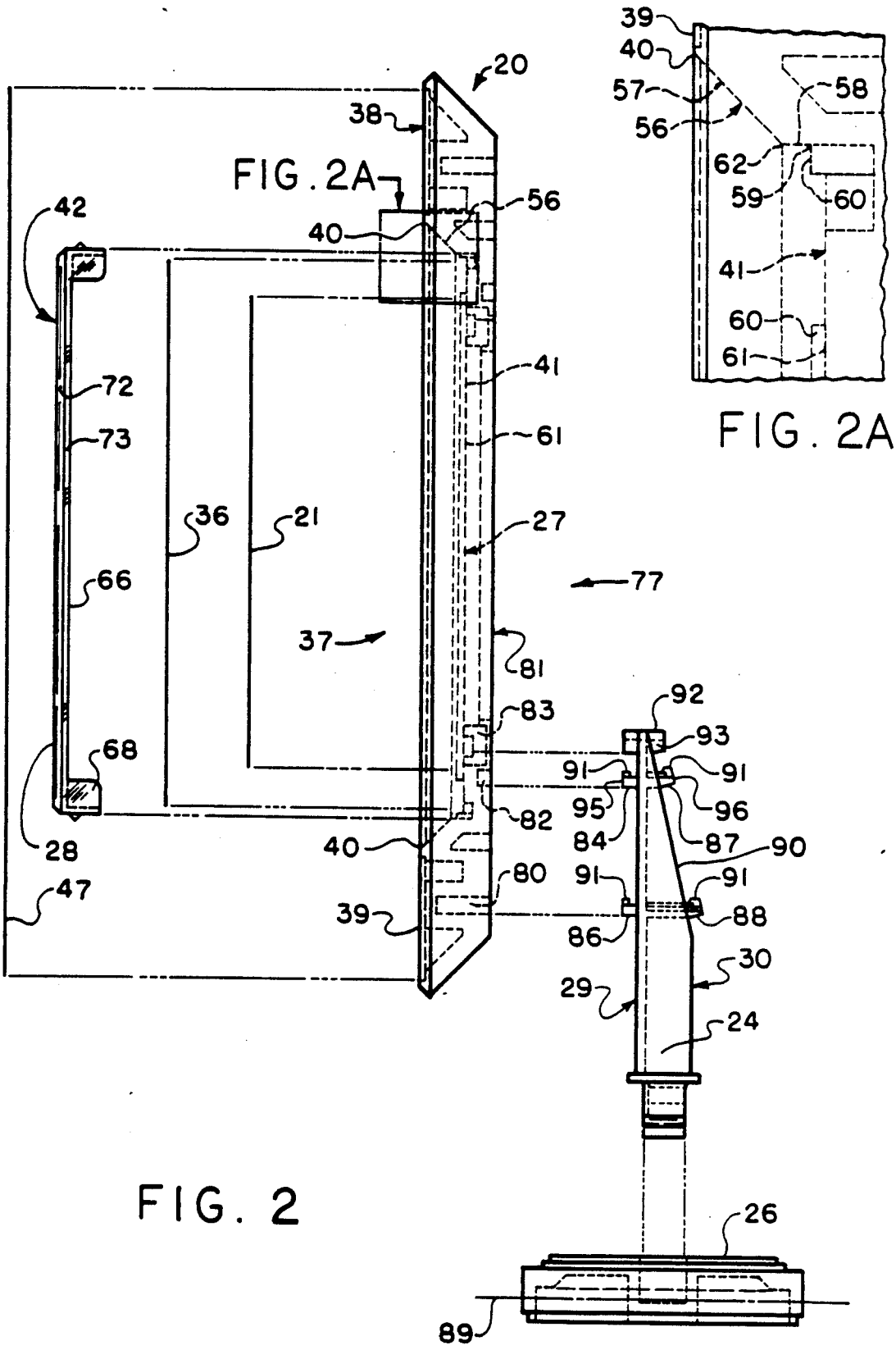
FIG. 2 is a exploded side view of the picture frame assembly shown in FIG. 1 with the piece of mat for covering the border illustrated.
FIG. 2A is a broken away enlarged view of the area designated 2A in FIG. 2.
Figure 3:
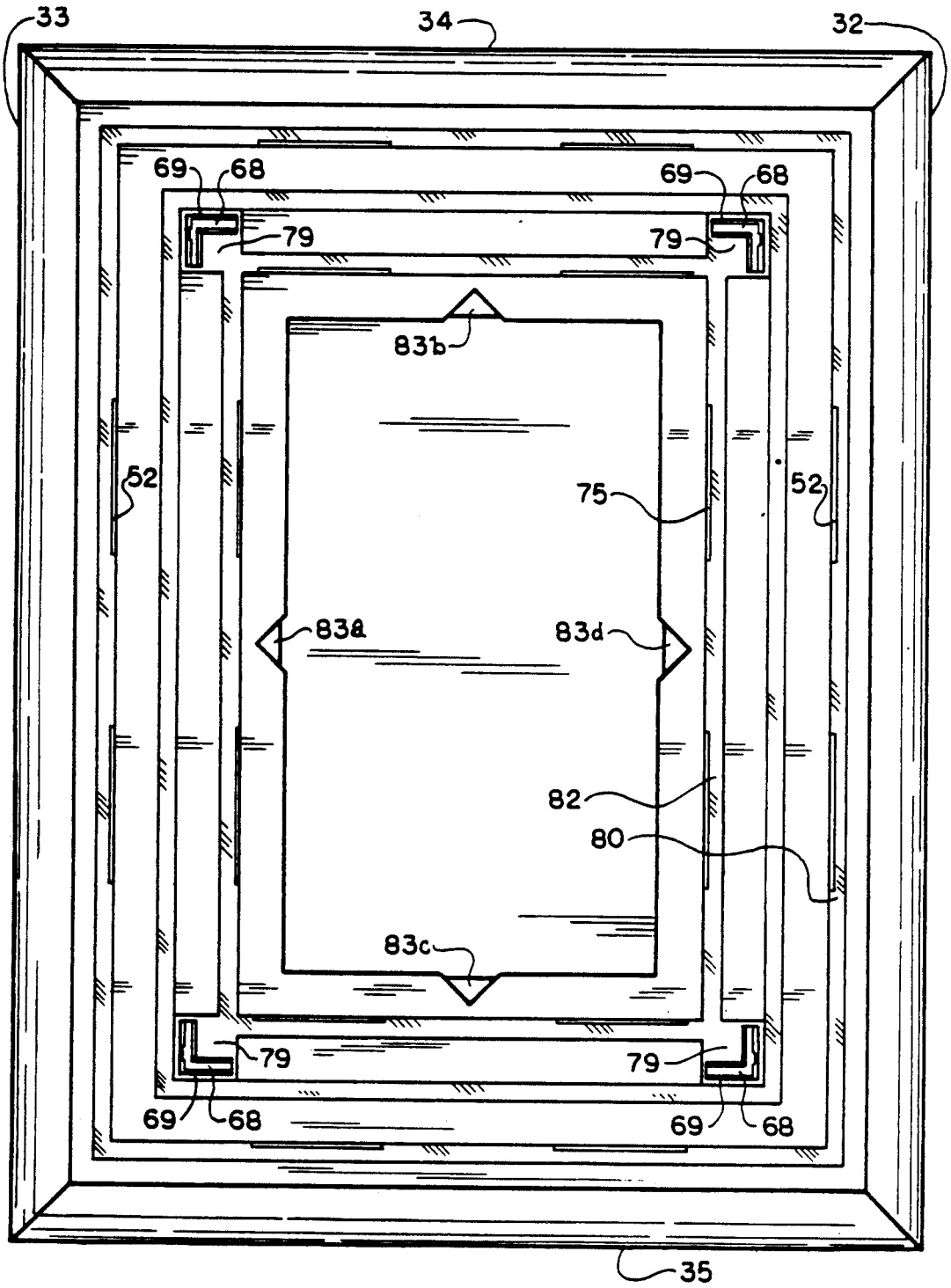
FIG. 3 is a rear plan view of the frame shown in FIG. 1.
Figure 9A:
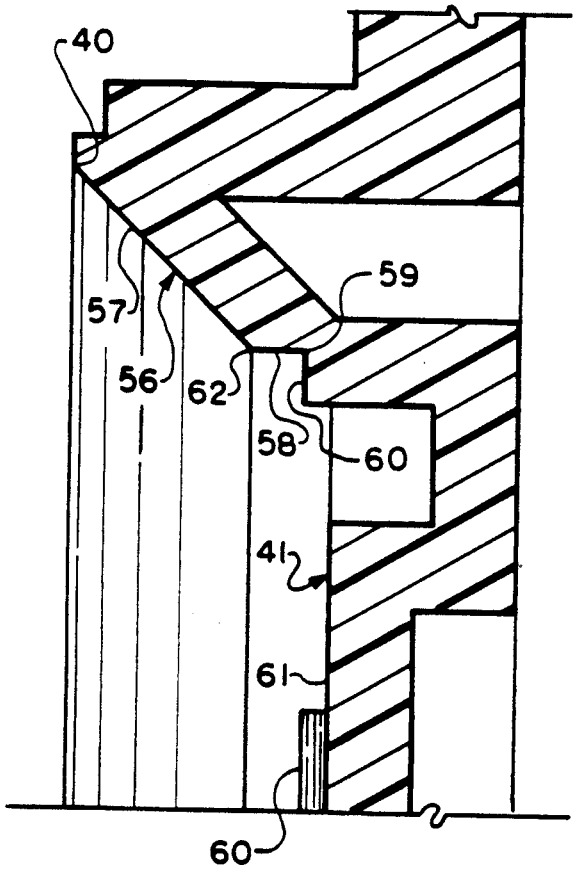
FIG. 9A is a broken away enlarged view of the area designated 9A in FIG. 9.

As seen more clearly in FIGS. 2A and 9A, recess 27 includes bottom surface 41 and sidewall 56. Sidewall 56 includes a bevelled portion 57 which comprises a major portion of the sidewall 56, and straight portion 58. At its outer edge 40, sidewall 56 intersects with the border portion 39 of the frame 22. At its inner edge 59, sidewall 56 intersects with the platform 60 which forms a portion of the bottom surface 41 of the recess 27. At the intersection of the straight portion 58 and the bevelled portion 57 is the inner edge 62 of the bevelled portion 57. In addition to platform 60, the bottom surface 41 of the recess 27 includes a back wall 61. Platform 60 serves to slightly space the cover 28 from the back wall 61 of the recess 27. The bevelled portion 57 of sidewall 56 converges inwardly from the border portion 39 of the frame 22 towards the rear side 81 of the frame 22. As seen in FIG. 2A, bevelled portion 57 extends at approximately a 45° angle with respect to the back wall 61 of the recess 27.

Upon installation of the photograph 21 and the mat 36 (both of which are preferably relatively thin), cover 28 is disposed entirely within the confines of the recess 27 such that the front surface 42 of the cover 28 is depressed within the recess 27 well below the opening of the recess 27 located in the front 37 of the frame 22. Cover 28 is preferably constructed in its entirety of a transparent or light transmitting material so as to allow the clear viewing of the photograph 21 and mat 36, which upon installation of the cover 28 are sandwiched within recess 27 between the cover 28 and the back wall 61 of the recess 27.

Figure 12:
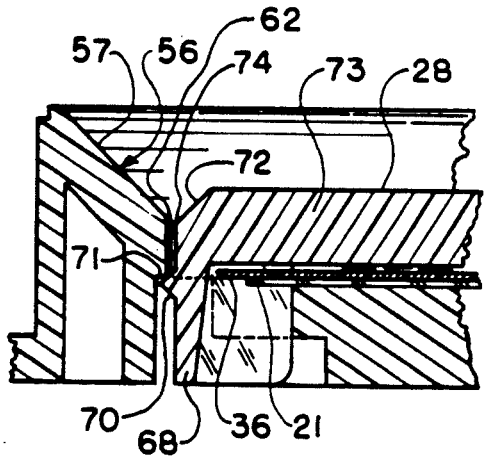
FIG. 12 is a sectional view taken along line 12—12 of FIG. 11.

Located at each corner of the cover 28, upon its rear surface 66, are L-shape legs 68. Legs 68 are received within and releasably engage sockets 69 formed in the bottom surface 41 of the recess 27. Provided along one edge of each of the L-shape legs 68 are detents 70. As shown in FIG. 12, upon insertion of the cover 28 into the recess 27, the detents 70 frictionally engage the walls 71 which form sockets 69 thereby ensuring the secure attachment of the cover 28, and thus the photograph 21 and mat 36, to the frame 22.

Figure 13:
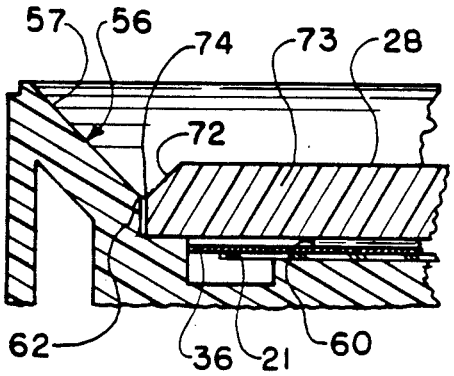
FIG. 13 is a sectional view taken along line 13—13 of FIG. 11.

The entire perimeter of the cover 28 includes a bevelled portion 72. Bevelled portion 72 extends rearwardly from the front cover 28 at approximately a 45° angle relative to the front surface 42 of the cover 28 to a depth which is a little more than one-half the thickness of the planar lens 73 of cover 28. As shown in FIGS. 12 and 13, upon installation of the cover 28, photograph 21 and mat 36 within the recess 27, the inner edge 74 of bevelled portion 72 of cover 28 is substantially contiguous with the inner edge 62 of the bevelled portion 57 of recess 27, providing a unique unobstructed view of the mat 36 and photograph 21. It will be appreciated that if a user wants to use multiple pieces of mat 36, or if the photograph 21 or mat are unusually thick, the back wall 61 of the recess 27 may have to be spaced or offset from the inner edge 62 of the bevelled portion 57 of side wall 56, and the height of the platform 60 relative to the back wall 61 may have to be increased so as to accommodate such unusually thick photograph or multiple pieces of mat and ensure that the inner edge 74 of the bevelled portion 72 of cover 28 aligns with the inner edge 62 of the bevelled portion 57 of side wall 56.

As shown in FIG. 4, provided along the bottom surface 41 of the recess 27 are a plurality of openings 75 and indentations 76. In addition to facilitating in the molding of the frame 22 and the conservation of material, these openings 75 and indentations 76 may be utilized to assist a user in aligning the photograph 21 and mat 36. If desired, a suitable adhesive or sticky dots may be utilized on the back wall 61 of the recess 27 to ensure the proper retention of the mat 36 and photograph 21 thereto during the installation of the cover 28 within the recess 27.

Cover 28 is easily installed within the recess 27 by aligning and centering the cover 28 within the recess 27, and then pushing the cover 28 into the recess 27 until the cover 28 is fully seated within the recess 27, the photograph 21 and mat 36 sandwiched against the back wall 61 of the recess 27. Cover 28 is easily removed from recess 27 so as to permit the changing of the mat 36 or photograph 21, or the cleaning of the cover 28, by pushing upon the legs 68 from the back 77 of the frame 22 with a user's fingers or thumbs. As shown, small cut out areas 79 are provided along the rear side 81 of the frame 22 to allow a user's fingers or thumbs to contact the ends of the legs 68.

Figure 7:
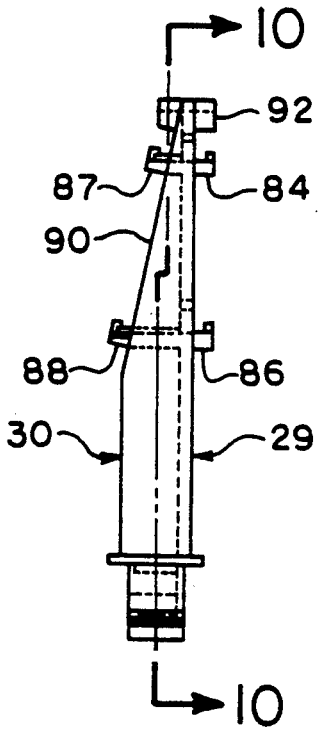
FIG. 7 is a side plan view of the upright support taken in the direction of lines 7—7 shown in FIG. 5.
Figure 8:
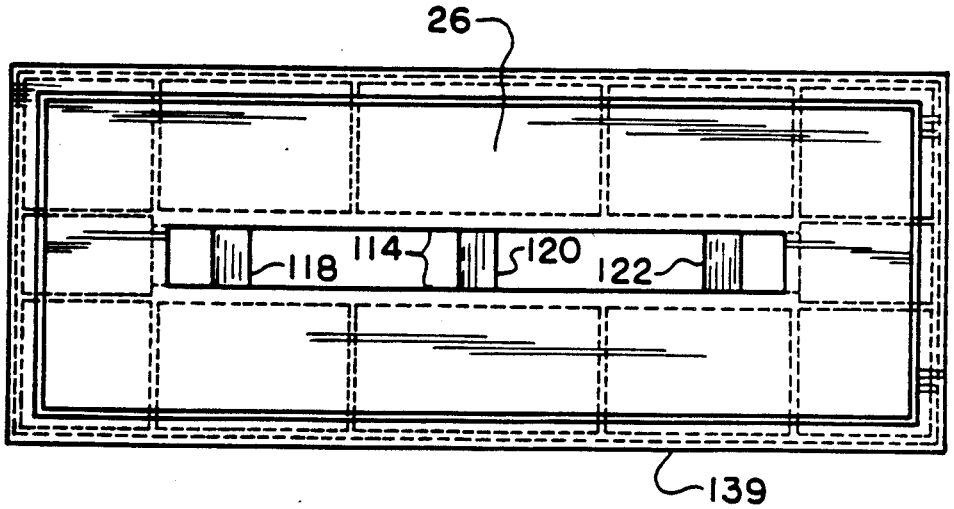
FIG. 8 is a top plan view of the base shown in FIG. 1.

Referring now additionally to FIGS. 5–10, the means by which the frame 22 is attached to the upright support 24 and the support 24 is mounted upon the base 26 are clearly shown. Specifically, included along the rear side 81 of the frame 22 are a pair of channels 80 and 82 and multiple V-shape openings 83*a*, 83*b*, 83*c* and 83*d*. Located along the front side 29 of the support 24 are a pair of protruding shelves, or top ledge 84 and bottom ledge 86. Similarly, included along the back side 30 of the support 24 are a pair of protruding shelves, or top ledge 87 and bottom ledge 88. As shown in FIGS. 2 and 7, the front side 29 of the support 24 includes a straight profile which extends substantially perpendicular to the horizontal axis 89 of the base 26 while the back side 30 of the support 24 includes an angled or slanted portion 90 which extends at about a 78° angle relative to the horizontal axis 89 of the base 26. Thus, as discussed below, depending upon which side of the support 24 the frame 22 is attached, the orientation of the frame 22 relative to the base 26 is different.

Figure 9:
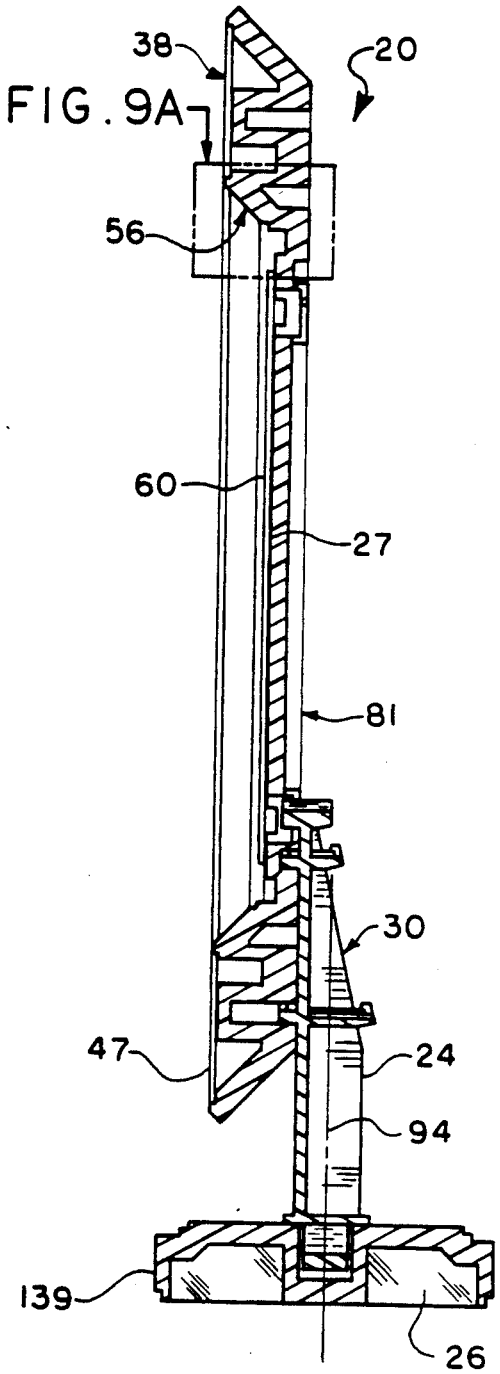
FIG. 9 is a sectional view of the picture frame assembly shown in FIG. 1 with the cover, mat and photograph which are received within the recess removed and the piece of mat covering the border illustrated.
Figure 10:
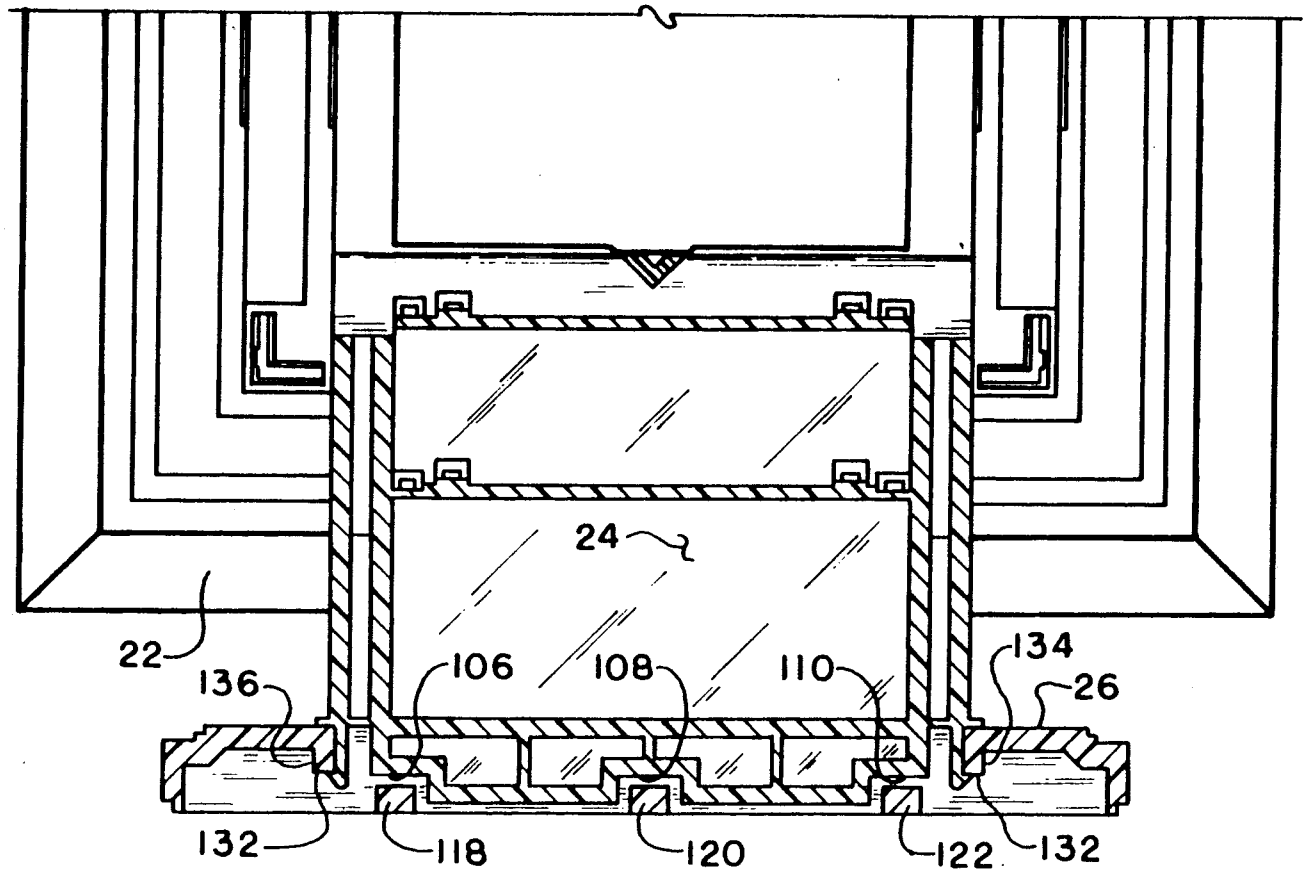
FIG. 10 is a broken away rear view of the frame, upright support and base shown in FIG. 1 with the upright support attached to the frame along its right edge and the upright support and base sectioned along line 10—10 as shown in FIG. 7.
Figure 11:
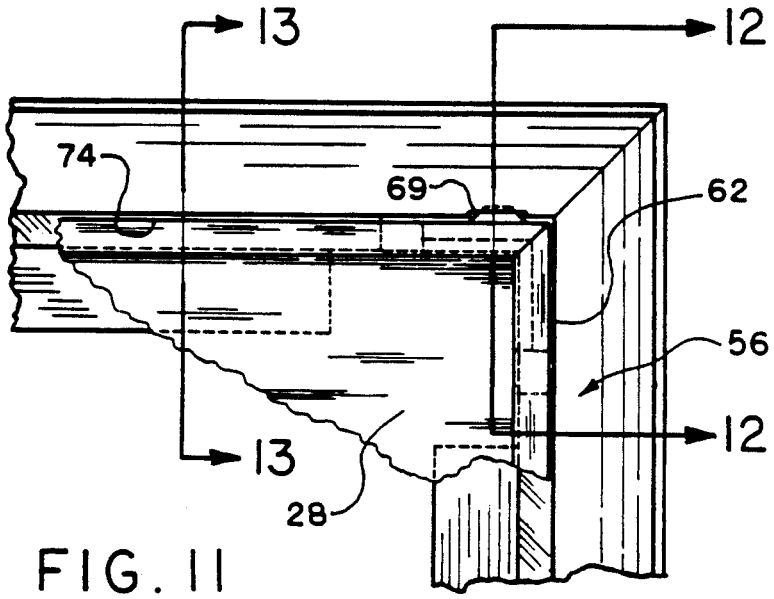
FIG. 11 is a broken away enlarged top view of the recess and cover of the frame shown in FIG. 1.
Figure 14:
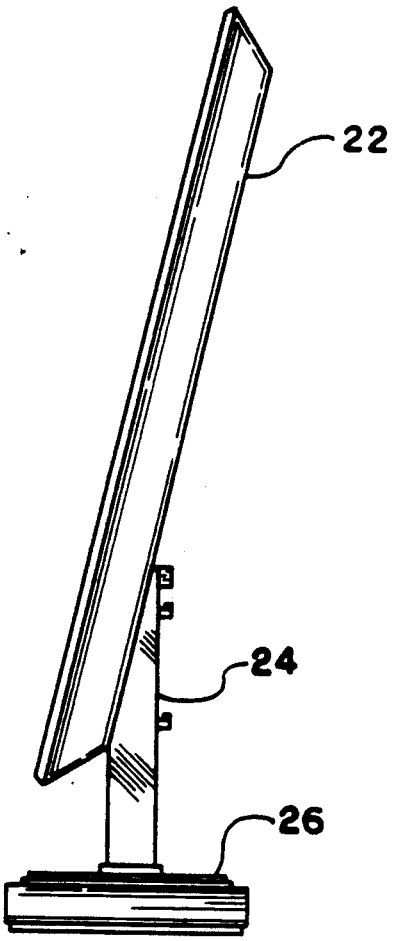
FIG. 14 is a side view of the frame, upright support and base shown in FIG. 1 with frame attached to the rear side of the upright support.
Figure 15:
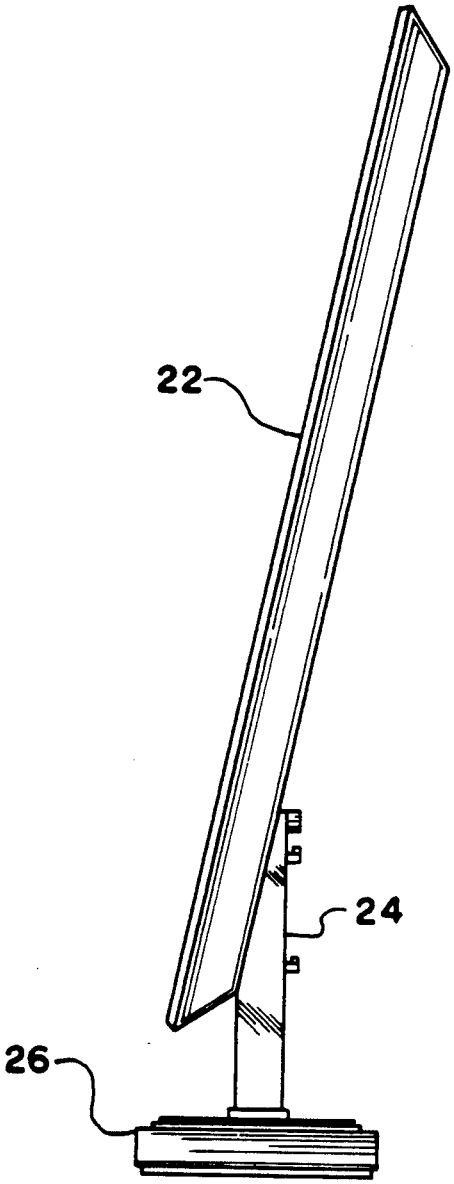
FIG. 15 is a side view of the frame, upright support and base shown in FIG. 1 with the upright support attached along the left edge of the frame.

Disposed upon each of the ledges 84, 86, 87 and 88 are a pair of protruding detents 91. Located at the top of the support 24 is a V-shape tab 92. V-shape tab 92 extends perpendicular to the vertical axis 94 of the support 24 from about the distal end 95 of the top ledge 84 located on the front side 29 of the support to the distal end 96 of the top ledge 87 located on the back side 30 of the support 24. Upon alignment of the tab 92 and the ledges 84 and 86 located on the front side 29 of the support 24 with the respective opening 83*a* and channels 82 and 80 on the rear side 81 of the frame 22 as shown in FIG. 2, the front side 29 of the support 24 may be pushed towards the frame 22, the ledges 84 and 86 being received within the channels 80 and 82 and the detents 91 thereof ensuring the engagement of the ledges 84 and 86 within the walls of the channel 80 and 82 as shown in FIG. 9. Simultaneously therewith, the outside surfaces 93 of tab 92 securely engage the walls which form the V-shape groove 83*a*. In the same manner, the back side 30 of the support 24 may be attached to the rear side 81 of the frame 22 as shown in FIG. 14. With this form of attachment the frame 22 is held at an angle relative to the horizontal axis 89 of the base 26 which corresponds to the angle formed between the slanted portion 90 of the support 24 and the horizontal axis 89 of the base 26. Thus, the support 24 affords for the user different viewing angles of the photograph 21 and mat 36. As shown in FIG. 15, in addition to providing attachment of the frame 22 to either side of the upright support 24, the upright support 24 may be attached to the frame 22 utilizing either openings 83*b* or 83*c* that are located along the minor lengths or the right side 34 or left side 35 of the frame 22. Likewise, in addition to attaching the frame 22 to the support 24 along the bottom side 33 utilizing groove 83*a*, groove 83*d* may be utilized to attach the support 24 to the frame 22 along the top side 32 thereof. Therefore, picture frame assembly 20 provides a considerable amount of flexibility for it allows the frame 22 to be mounted upon the support 24 in a total of 8 different orientations relative to the base 26.

Included at the bottom of the upright support 24 are a pair of diametrically opposed tabs 100 and 101, and a male plug 104 having multiple depressions 106, 108 and 110 formed therein. Formed in the base 26 is a socket 114 having multiple cross-pieces 118, 120 and 122. Cross-pieces 118, 120 and 122 correspond respectively to the depressions 106, 108 and 110 in location and size. Upon the initial insertion of the upright support 24 into the base 26, the tabs 100 and 101 deflect inwardly. Upon continued insertion the cross-pieces 118, 120 and 122 engage the respective indentations 106, 108 and 110 preventing any further travel of the plug 104 into the socket 114. Simultaneously therewith, the tabs 100 and 101 return to their unbiased position with the protrusions 130*a* and 130*b* provided at the ends of the tabs 100 and 101 engaging the respective bottom edges 132 of the end walls 134 and 136 which form the socket 114. Removal of the upright support 24 from the base 26 is easily accomplished by pulling the pieces apart and at the same time deflecting the tabs 100 and 101 inwardly with a user's fingers so as to cause the tabs 100 and 101 to move out of engagement with the bottom edges 132 of end walls 134 and 136. Since both the plug 104 and the socket 114 are symetrical, it will be appreciated that the upright support 24 may be inserted into the base 26 such that the straight front side 29 or the back side 30 of the upright support 24 face the front side 139 of the base 26.

Although in the preferred embodiment the frame 22 has been shown to be rectangular, it will be appreciated that the present invention contemplates the use of a frame of anyone of a variety of shapes such as, for example, a square or round frame. Similarly, the present invention is in no way limited to the disclosed rectangular cover 28 and recess 27. A picture frame made in accordance with the present invention may have a cover and recess having anyone of a variety of shapes.

Although the invention has been shown and described with respect to a certain preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A picture frame assembly for displaying a two dimensional work of art, comprising:

a frame adapted to have the artwork mounted thereon, said frame having a front side and a rear side, said rear side including a pair of channels, a base, and an upright support interconnecting said frame with said base, said upright support having a front side with a first geometric profile and a back side with a second geometric profile, said front side having first connecting means for selectively connecting the front side of said support to the rear side of said frame, said back side including second connecting means for selectively connecting the back side of said support to the rear side of said frame, said first and second connecting means each comprising a pair of protruding ledges which are adapted to be received within and engage said channels of said frame, and said first and second connecting means each including a protruding tab.

2. A picture frame assembly as set forth in claim 1 wherein said rear surface of said frame includes a V-shape opening for selectively receiving and engaging said protruding tab of said front side of said support or said protruding tab of said back side of said support.

3. A picture frame assembly as set forth in claim 2 wherein said rear side of said frame includes multiple V-shape openings for selectively engaging said support.

4. A picture frame assembly as set forth in claim 3 wherein said frame includes a right, left, top and bottom length, and said pair of channels and said V-shape openings extend along the right, left, top and bottom lengths of said frame so as to facilitate the selective attachment of said support to said frame along either of the top, bottom, right or left length of said frame.

5. A picture frame assembly as set forth in claim 4 wherein said base is detachable from said support.

6. A picture frame assembly as set forth in claim 4 wherein said support includes detachment means for attaching and detaching said support to said base.

7. A picture frame assembly as set forth in claim 6 wherein said detachment means comprises a pair of diametrically opposed flexible tabs for releasably engaging said base.

8. A picture frame as set forth in claim 6 wherein said front side of said frame includes a recess for receiving said cover and the artwork, said recess having a bottom surface, said bottom surface of said recess including a bottom wall for engaging the artwork and a protruding platform which serves to space said rear surface of said cover from said bottom surface of said recess.

9. A picture frame assembly for displaying a two dimensional work of art, comprising:

a frame, a removable cover, and an upright support for supporting said frame, said frame having a front side and a rear side, said front side including a recess for receiving said cover ant the artwork, said cover consisting essentially of a transparent sheet of material adapted to be attached to said recess and enclose the artwork therebetween, said upright support having a front side with a first geometric profile and a back side with a second geometric profile, said rear side of said frame selectively attachable to either said front side or said back side of said upright support, said upright support supporting said frame in different geometric orientations depending on which side of said upright suppport said frame is attached.

10. A picture frame assembly as set forth in claim 9, wherein said front side of said frame includes a border portion, said border portion including a mounting surface adapted to have a matting piece adhesively attached thereto.

11. A picture frame assembly as set forth in claim 10 wherein said frame includes a second piece of mat for mounting within said recess between said cover and said frame.

12. A picture frame assembly as set forth in claim 11 wherein said recess includes a bottom surface having a back wall and a platform for spacing said cover from said back wall of said recess.

* * * * *